US008459775B2

(12) United States Patent
Kaieda et al.

(10) Patent No.: US 8,459,775 B2
(45) Date of Patent: Jun. 11, 2013

(54) LIQUID EJECTING HEAD, LIQUID EJECTING HEAD UNIT AND LIQUID EJECTING APPARATUS

(75) Inventors: Teruaki Kaieda, Matsumoto (JP); Shinichi Itaya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 86 days.

(21) Appl. No.: 13/006,241

(22) Filed: Jan. 13, 2011

(65) Prior Publication Data

US 2011/0187791 A1 Aug. 4, 2011

(30) Foreign Application Priority Data

Feb. 1, 2010 (JP) ..... 2010-020795

(51) Int. Cl.

| | |
|---|---|
| ***B41J 2/185*** | (2006.01) |
| ***B41J 2/165*** | (2006.01) |
| ***B41J 2/09*** | (2006.01) |
| ***B41J 2/215*** | (2006.01) |

(52) U.S. Cl.
USPC ..... 347/34; 347/28; 347/73; 347/77; 347/82; 347/90

(58) Field of Classification Search
USPC ..... 347/28, 34
See application file for complete search history.

(56) References Cited

U.S. PATENT DOCUMENTS

| | | | | |
|---|---|---|---|---|
| 6,513,918 | B1 * | 2/2003 | Faisst et al. | 347/73 |
| 6,719,398 | B1 * | 4/2004 | McElfresh et al. | 347/21 |
| 6,886,905 | B2 * | 5/2005 | McElfresh et al. | 347/21 |
| 6,997,538 | B1 * | 2/2006 | Kawamura et al. | 347/21 |
| 7,413,293 | B2 * | 8/2008 | Jeanmaire | 347/77 |
| 2002/0101474 | A1 * | 8/2002 | Hawkins et al. | 347/40 |
| 2007/0285456 | A1 * | 12/2007 | Takasu et al. | 347/19 |
| 2008/0284818 | A1 * | 11/2008 | Anagnostopoulos | 347/40 |
| 2008/0284835 | A1 * | 11/2008 | Panchawagh et al. | 347/90 |
| 2009/0002468 | A1 * | 1/2009 | Ito | 347/92 |
| 2009/0244180 | A1 * | 10/2009 | Panchawagh et al. | 347/44 |

FOREIGN PATENT DOCUMENTS

| | | |
|---|---|---|
| JP | 05-016370 | 1/1993 |
| JP | 2000-062166 | 2/2000 |

* cited by examiner

*Primary Examiner* — Matthew Luu
*Assistant Examiner* — Alexander D Shenderov
(74) *Attorney, Agent, or Firm* — Workman Nydegger

(57) ABSTRACT

A liquid ejecting head including: a head main body that has a nozzle opening for ejecting liquid, a rectifying plate that is disposed in a position away from the liquid ejecting surface on which the nozzle opening is opened and has an opening disposed in an area facing the nozzle opening, and an air stream generating unit that generates an air stream between the liquid ejecting surface and the rectifying plate along the surface direction of the liquid ejecting surface.

11 Claims, 9 Drawing Sheets

LIQUID EJECTING HEAD, LIQUID EJECTING HEAD UNIT AND LIQUID EJECTING APPARATUS

The entire disclosure of Japanese Patent Application No: 2010-020795, filed Feb. 1, 2010 are expressly incorporated by reference herein.

BACKGROUND

1. Technical Field

The present invention relates to a liquid ejecting head that ejects liquid from nozzle openings, a liquid ejecting head unit and a liquid ejecting apparatus.

2. Related Art

The liquid ejecting apparatus that is represented by an ink jet type recording apparatus such as an ink jet type recording head, a plotter or the like includes a liquid ejecting head (hereinafter, also referred to as the recording head) that can eject a liquid such as ink or the like reserved in a liquid reservoir such as a cartridge, a container or the like, as liquid droplets (ink droplets).

A serial-type liquid ejecting apparatus and a line-type liquid ejecting apparatus in practical use as the liquid ejecting apparatus wherein the serial-type liquid ejecting apparatus performs a printing by moving the liquid ejecting head in a scanning direction with respect to an recording medium that is a recording sheet or the like such as paper or the like, and the line-type liquid ejecting apparatus performs a printing by fixing the liquid ejecting head in which nozzle openings are disposed over the width of the recording medium and transporting only the recording medium (for example, see JP-A-5-16370).

However, even in either of the serial-type and the line-type liquid ejecting apparatuses, because the recording medium and the liquid ejecting head are moved relatively, air stream is generated by the relative movement and when ink is ejected from the nozzle openings, a small liquid droplet (one referred to as mist or a satellite droplet) that is separated from a main droplet (main liquid droplet) is generated, and the small liquid droplet is attached in a separate position to the main droplet on the recording medium by the flow of the air stream so that printing quality is lowered. Also, the small liquid droplet is attached to the meniscus of the liquid at the liquid openings and destroys the meniscus so that the liquid droplets cannot be ejected normally from the nozzle openings.

To solve the above-described problem, a drawing head apparatus is suggested in which a hood is disposed on a liquid ejecting surface that ejects the ink of the recording head so as to cover a vicinity of the recording medium from the nozzle openings. The drawing head apparatus suppresses that small liquid droplets are landed in the position other than the main droplet by the air stream that is generated by the relative movement of the recording medium and the recording head (for example, see JP-A-2000-62166).

However, in JP-A-2000-62166, there are problems in that if only by disposing the hood on the recording head, a turbulent air stream that is directed by the hood is inversely generated and the small liquid droplet lands in a position separate to the main droplet on the recording medium so that printing quality is lowered and destruction of the meniscus is generated.

Specifically, in a case where the relative movement of the recording head and the recording medium reaches a high velocity, and high velocity printing is performed, the above-described problems are noticeably present.

These problems are present not only in an ink jet type recording head that ejects ink but also in a liquid ejecting head that ejects liquids other than ink similarly.

SUMMARY

An advantage of some aspects of the invention is that it provides a liquid ejecting head, a liquid ejecting head unit and a liquid ejecting apparatus to suppress the landing of the small liquid droplets toward the recording medium and liquid ejection failure due to small liquid droplets so that printing quality can be improved.

According to an aspect of the invention, there is providing a liquid ejecting head including: a head main body that has a nozzle opening for ejecting liquid, a rectifying plate that is disposed in a position away from the liquid ejecting surface on which the nozzle opening is opened and has an opening disposed in an area facing the nozzle opening, and an air stream generating unit that generates air stream between the liquid ejecting surface and the rectifying plate along the surface direction of the liquid ejecting surface.

In the aspect of the invention, the main droplet of the liquid droplets that are ejected from the nozzle opening is not moved by the air stream in a direction intersecting with the ejection direction and advances straight to land on the recording medium; and a small liquid droplet that is separated from the main droplet is moved by the air stream so that the small liquid droplet lands on the rectifying plate and can be suppressed from landing in the recording medium, or from attaching to the meniscus at the nozzle opening.

It is preferable that there is provided a wall portion that covers at least both surfaces in a direction intersecting with the air stream direction on the periphery of the space between the liquid ejecting surface and the rectifying plate. Accordingly, the air stream that occurs due to the relative movement of the recording medium and the liquid ejecting head, an external air stream or the like are shielded by the wall portion so that the generation of air streams that are different from the air stream generated by the air stream generating unit in vicinity of the liquid ejecting surface can be suppressed.

It is preferable that the wall portion is disposed over the periphery opposed to the liquid ejecting surface of the rectifying plate. Accordingly, influence of the air stream that occurs due to the relative movement of the recording medium and the liquid ejecting head, the external air stream or the like can be reliably further suppressed.

It is preferable that the liquid ejecting head includes a plurality of head main bodies and the wall portion is continuously disposed over the periphery of the plurality of head main bodies. Accordingly, the number of parts is decreased and the costs can be reduced.

It is preferable that the rectifying plate is made of mesh shaped material. Accordingly, the costs can be reduced.

It is preferable that the air stream generating unit generates an air stream of gas having moisture. Accordingly, drying of the liquid in the vicinity of the nozzle openings is prevented from being promoted and ejection failure due to drying and hardening of the liquid can be decreased by the air stream generated by the air stream generating unit.

According to another aspect of the invention, a liquid ejecting head unit including the above-described two or more liquid ejecting heads is provided.

According to an aspect of the invention, a head unit that has multiple nozzles can be easily formed.

According to still another aspect of the invention, a liquid ejecting apparatus including the above-described liquid ejecting head or liquid ejecting head unit is provided.

In the aspect of the invention, printing quality can be improved so that the liquid ejecting apparatus capable of high velocity printing can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter the invention will be described in detail on the basis of the embodiments.

First Embodiment

Figure 1:
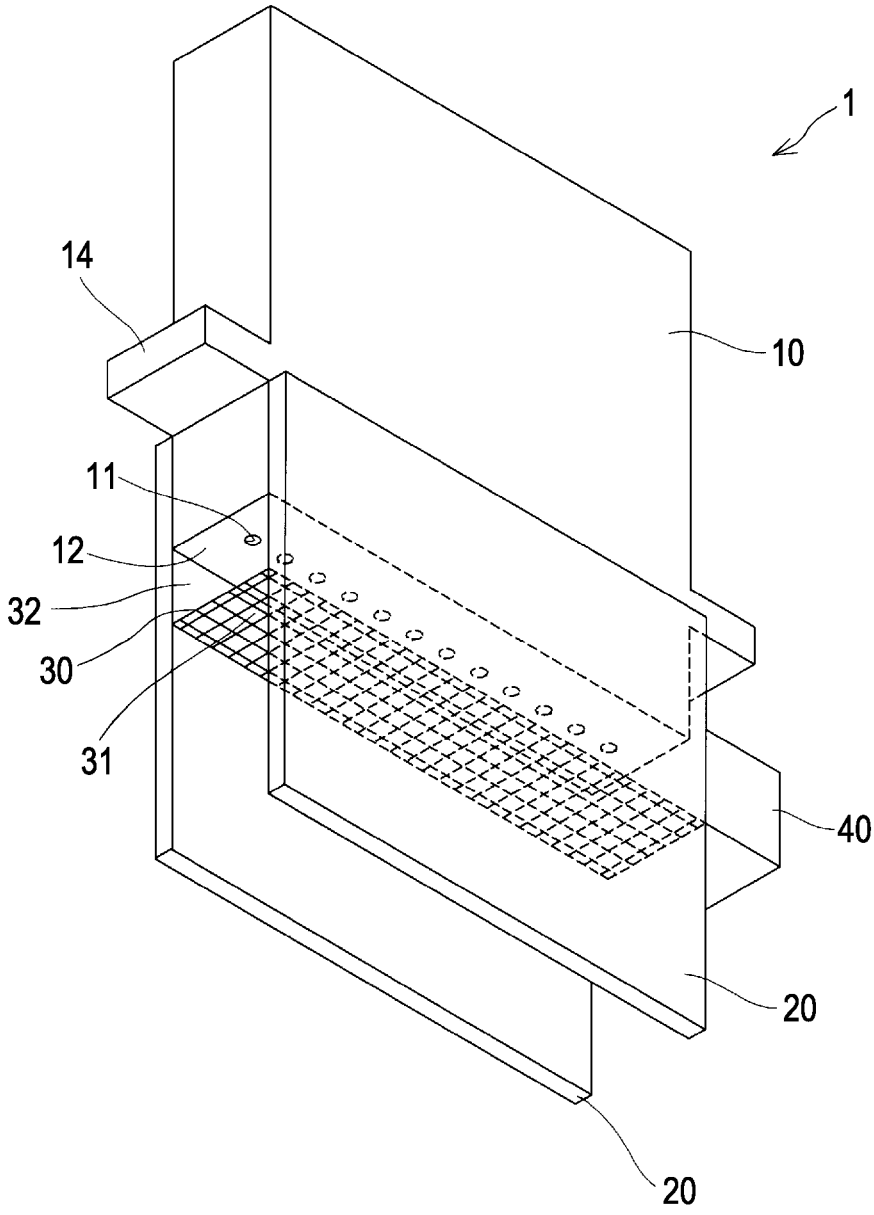
FIG. 1 is a perspective view of a recording head according to a first embodiment.
Figure 2A:
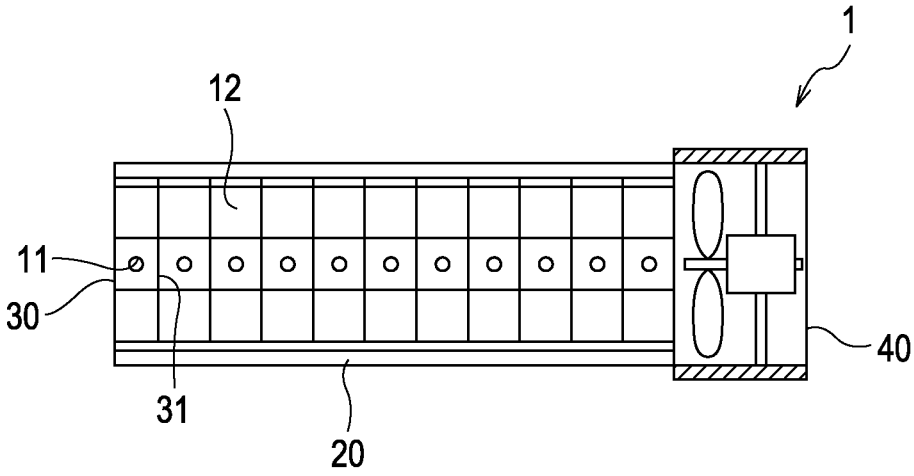
FIG. 2A is a bottom plan view of the recording head according to the first embodiment.
Figure 2B:
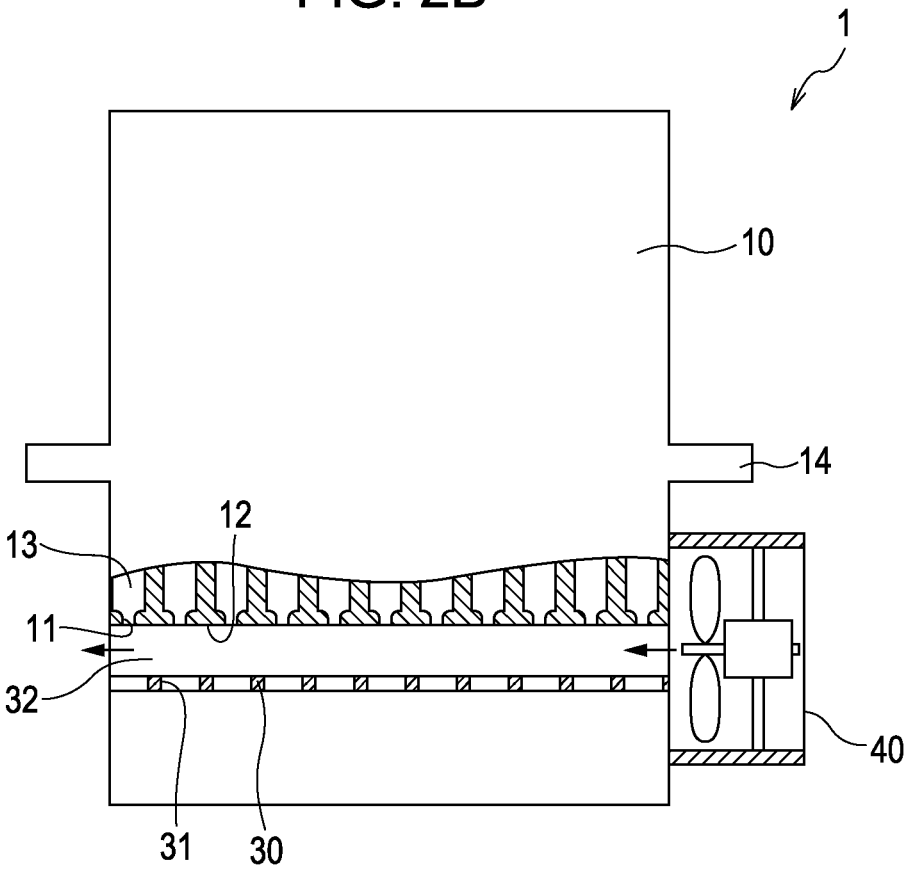
FIG. 2B is a cross-sectional view of main portions of the recording head according to the first embodiment.

FIG. 1 is a perspective view of the ink jet type recording head that is an example of a liquid ejecting head according to the first embodiment of the invention, FIG. 2A is a bottom plan view of the ink jet type recording head and FIG. 2B is a cross-sectional view of main portions of the ink jet type recording head.

As shown in FIG. 1, the ink jet type recording head (hereinafter, also referred to as recording head 1) which is an example of the liquid ejecting head of the embodiment includes a head main body 10, wall portions 20 that cover a liquid ejecting surface 12 of the head main body 10, a rectifying plate 30 that is fixed on the wall portion 20 and an air stream generating unit 40.

A plurality of nozzle openings 11 that eject the ink as the liquid are opened and disposed on one surface of the head main body 10. The surface on which the nozzle openings 11 are opened is the liquid ejecting surface 12 that ejects the ink as the liquid.

The head main body 10 has flow passages 13 which communicate with the nozzle openings 11 in the inside thereof and generates a pressure change in the ink within the flow passages 13 by a pressure generating unit (not shown) so that ink droplets are ejected from the nozzle openings 11. Also, as the pressure generating unit that generates the pressure change within the flow passages 13, for example, a piezoelectric actuator, another type of actuator or an electrostatic type actuator may be used, wherein the piezoelectric actuator uses a piezoelectric element having a piezoelectric material that presents an electro-mechanical conversion function, the other type actuator has a heat generating element that is arranged within the flow passages 13 and ejects ink droplets from the nozzle openings 11 using bubbles that are generated by the heat of the heat generating element, and the electrostatic type actuator generates static electricity between a vibration plate and electrodes so that the vibration plate is deformed by an electrostatic force, a pressure is changed within the flow passages 13 and thus the ink droplets are ejected from the nozzle openings 11.

The wall portion 20 are disposed on the side surface of the liquid ejecting surface 12 of the head main body 10. In the embodiment, the wall portions 20 are disposed on both side surfaces intersecting with a direction of the rows in which the nozzle openings 11 of the head main body 10 are successively provided, at the periphery of the side surfaces of a space 32 between the liquid ejecting surface 12 and the rectifying plate 30 which is described below. A pair of wall portions 20 project and are fixed at the side surface of the head main body 10 to the vicinity of an recording medium toward the ink ejecting direction in which the ink is ejected from the liquid ejecting surface 12. In other words, the wall portions 20 are connected to the opposite side of the liquid ejecting surface 12 of the rectifying plate 30 which is described below.

The rectifying plate 30 is fixed within the wall portions 20 (between the wall portions 20). The rectifying plate 30 consists of plate shaped member that faces the liquid ejecting surface 12 and is disposed at a position separated from the liquid ejecting surface 12. Openings 31, which have a size through which the ejected ink droplets (main droplets) from the nozzle openings 11 can pass through, are disposed at an area that faces each of nozzle openings 11 in the rectifying plate 30. As the openings 31 that face the nozzle openings 11 and through which the main droplets can pass through, the opening 31 for example, may be disposed at each of the nozzle openings 11 independently, or may also be disposed corresponding to nozzle opening groups which consist of two or more nozzle openings 11. In other words, one opening 31 may be disposed at each of the nozzle openings 11 or one opening 31 may also be commonly disposed in the plurality of nozzle openings 11.

Also, the rectifying plate 30 may be entirely clogged except the openings 31, or other openings may even be disposed outside the area facing the nozzle openings 11. The rectifying plate 30 in which other openings are disposed outside the area that faces the nozzle openings 11, is a lattice shape made from, for example, metal, resin, textile, unwoven material, paper or the like so that the rectifying plate 30 is made of a mesh member in which the openings 31 are disposed in a grid shape. When the pitch (interval) of the openings 31 of the mesh member is an integer multiple of the pitch of the nozzle openings 11, the openings 31 may be set to face all the nozzle openings 11. Also, as described above, the size and the pitch of the opening 31 of the mesh member is provided such that one opening 31 may be disposed so as to face each of the nozzle openings 11 or one opening 31 may also be disposed so as to face the plurality of nozzle openings 11.

As a material of the rectifying plate 30, for example, metal material, resin material, textile, unwoven material, paper or the like may be used, but it is not limited to the above-described materials. However, as the rectifying plate 30, a material having water absorbability is used, so that when the ink attaches to the rectifying plate 30, the ink is absorbed and maintained in the rectifying plate 30 having water absorbability, and the ink that is attached on the rectifying plate 30 can be suppressed from dropping and attaching to the recording medium at an unanticipated timing.

As described above, the rectifying plate 30 is arranged in the predetermined position separated in the predetermined distance from the liquid ejecting surface 12. Thus, the space 32 for moving small liquid droplets is formed between the rectifying plate 30 and the liquid ejecting surface 12.

The rectifying plate 30 is preferably disposed in the vicinity of the liquid ejecting surface 12 between the liquid ejecting surface 12 and the recording medium. The main droplets that are ejected from the nozzle opening 11 are largely affected by a misalignment of the ejecting direction and the air stream according to the separation from the nozzle openings 11. Because there is concern that the main droplets may land in a position that is misaligned with the nozzle opening 11, when the rectifying plate 30 is separated from the liquid ejecting surface 12, errors are increased so that there is concern that the main droplets may not pass the openings 31 of the rectifying plate 30. Accordingly, the rectifying plate 30 is disposed in the vicinity of the liquid ejecting surface 12 so that the main droplet that is ejected from the nozzle opening 11 can easily pass the opening 31. In the embodiment, the interval between the liquid ejecting surface 12 and rectifying plate 30 is about 1 mm.

The air stream generating unit 40 generates the air stream along the surface direction of the liquid ejecting surface 12 at the space 32 between the liquid ejecting surface 12 and the rectifying plate 30, and is a blower that is fixed on the wall portions 20 in the embodiment.

In the embodiment, the air stream generating unit 40 is fixed at one side surface in the direction of the rows of the nozzle openings 11 in which the space 32 between two wall portions 20 is opened so that the air stream generating unit 40 generates the air stream along the inside surface of the wall portions 20 within the space 32 of two wall portions 20. In other words, the air stream generating unit 40 that consists of the blower blows air along the direction of the rows of the nozzle openings 11 so that the air stream is generated along the surface direction of the wall portions 20 and the liquid ejecting surface 12 within the space 32 between the liquid ejecting surface 12 and the rectifying plate 30.

The air stream generating unit 40 is not limited to the blower and for example, a suction pump or the like may be disposed as the air stream generating unit 40.

The air stream that is generated by the air stream generating unit 40 will be described in detail below. The air stream has a flow velocity at which the main droplet of the ink droplet that is ejected from the nozzle opening 11 advances straight without being influenced by the air stream and at which a small liquid droplet, which is separated from the main droplet, is affected by the air stream. In other words, because the size (mass) of the main droplet or the size (mass) of the small liquid droplet is changed by the influence of the performance of the pressure generating unit, the driving waveform that defines the weight or velocity of the ejected ink droplet or the like, the size (mass) thereof may be properly determined according to these.

In the embodiment, because the upstream and the downstream of the air stream that is generated by the air stream generating unit 40 are openings on which the wall portions 20 are not disposed, the air stream that is generated by the air stream generating unit 40 does not generate turbulent air stream and the air stream generating unit 40 can generate the air stream along the direction of the rows of the nozzle openings 11.

Description regarding the ejection of the ink droplet of the recording head 1 will be made in reference to FIGS. 3A to 3D. FIGS. 3A to 3D are cross-sectional views of main portions of the ink jet type recording head showing the ejecting states of the ink droplet.

Figure 3A:
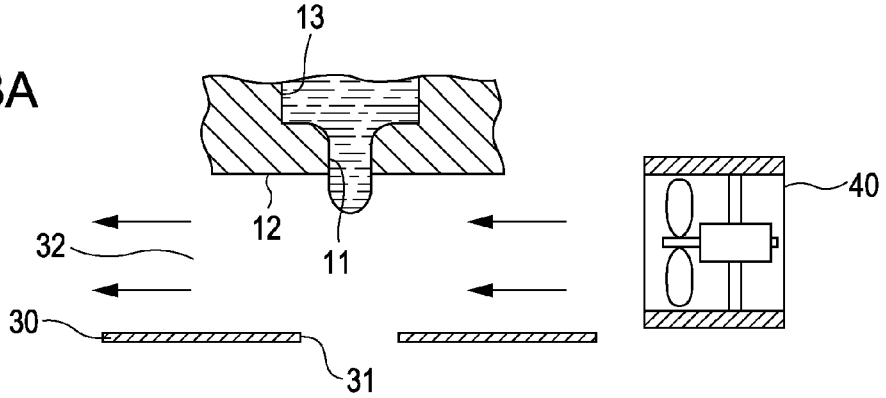
FIGS. 3A to 3D are cross-sectional views of main portions showing an operation of the recording head according to the first embodiment.
Figure 3B:
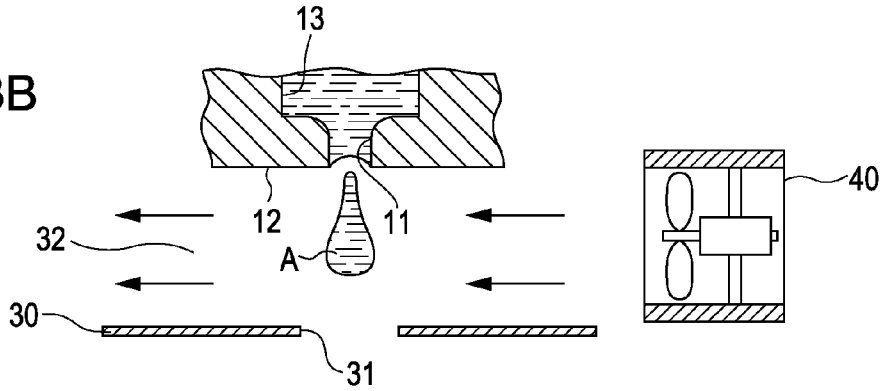
Figure 3C:
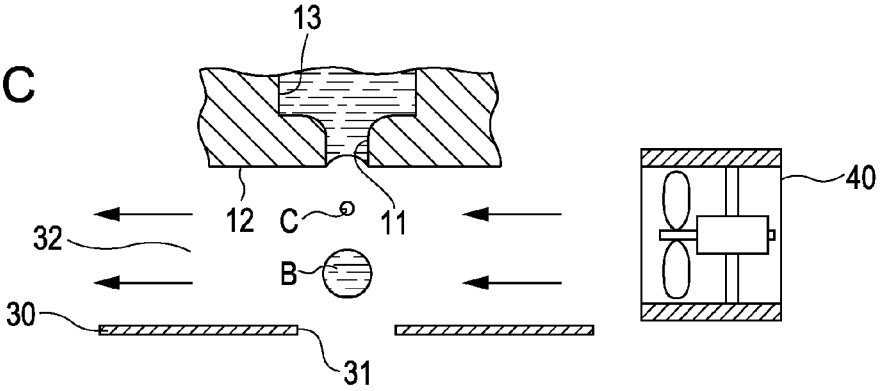

As shown in FIG. 3A, in the state where the air stream is generated by the air stream generating unit 40 in the space 32 between the liquid ejecting surface 12 and the rectifying plate 30, the pressure is changed within the flow passage 13 by the pressure generating unit (not shown) so that ejection of the ink droplet is started. Thus, the meniscus from the nozzle opening 11 takes a pillar shape and as shown in FIG. 3B, a part of the pillar shape is cut so that the ink droplet A is ejected from the nozzle opening 11. At this time, the ink droplet A flies, as a trail section thereof has an elongated shape. As shown in FIG. 3C, some of the trail section of the ink droplet A is separated and divides into the main droplet B (main liquid droplet) and the small liquid droplet C (a satellite droplet). Also, the small liquid droplet C is generated even when some of the pillar shape is separated and the ink droplet A is divided in FIG. 3B.

Figure 3D:
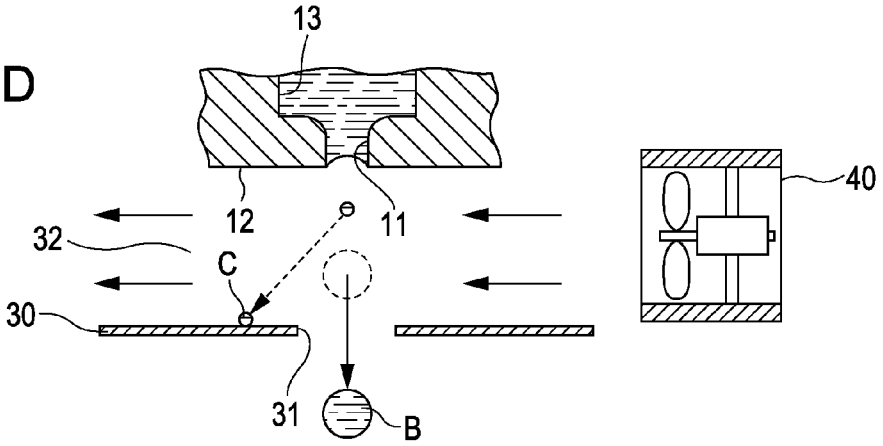

As shown in FIG. 3D, the main droplet B that is ejected as described above has a mass bigger than that of the small liquid droplet C so that it passes through the opening 31 of the mesh shaped rectifying plate 30 without being carried by the air stream. The main droplet B that has been passed through the opening 31 is landed in a desired position of the recording medium. Meanwhile, because the small liquid droplet C has a mass smaller than that of the main droplet B, it is moved to the area on which the opening 31 of the rectifying plate 30 is not disposed by the air stream and lands on the rectifying plate 30. Accordingly, the small liquid droplet C is not landed on the recording medium, and in addition, it can be prevented that the small liquid droplet that has flown is floated by turbulent air stream and attached to the meniscus of the nozzle opening 11 to destroy the meniscus. Thus, printing quality is prevented from being lowered due to the influence of the small liquid droplet C and printing quality can be improved.

Because the small liquid droplet C is prevented from being landed on the recording medium, the flying velocity of the ink droplet A (the main droplet B) can be increased. In other words, when the flying velocity of the ink droplet A is increased, the trail section becomes long and the small liquid droplets C that are separated are largely generated. However, in the embodiment, even when the small liquid droplets C are generated in a large quantity, the small liquid droplets C are landed on the rectifying plate 30 and the small liquid droplets C can be prevented from being landed on the recording medium so that the flying velocity of the ink droplet A (the main droplet B) can be increased.

Furthermore, landing of the small liquid droplet C on the recording medium can be suppressed, so that the relative moving velocity between recording medium and the recording head 1 is increased, and the high velocity printing can be realized. In other words, when the relative moving velocity between recording medium and the recording head 1 is increased, turbulent air is generated and the small liquid droplet C are generated in a large quantity or misalignment of the landing positions occurs frequently. However, in the embodiment, the small liquid droplets C are landed on the rectifying plate 30 so that the high velocity printing is realized.

Figure 4:
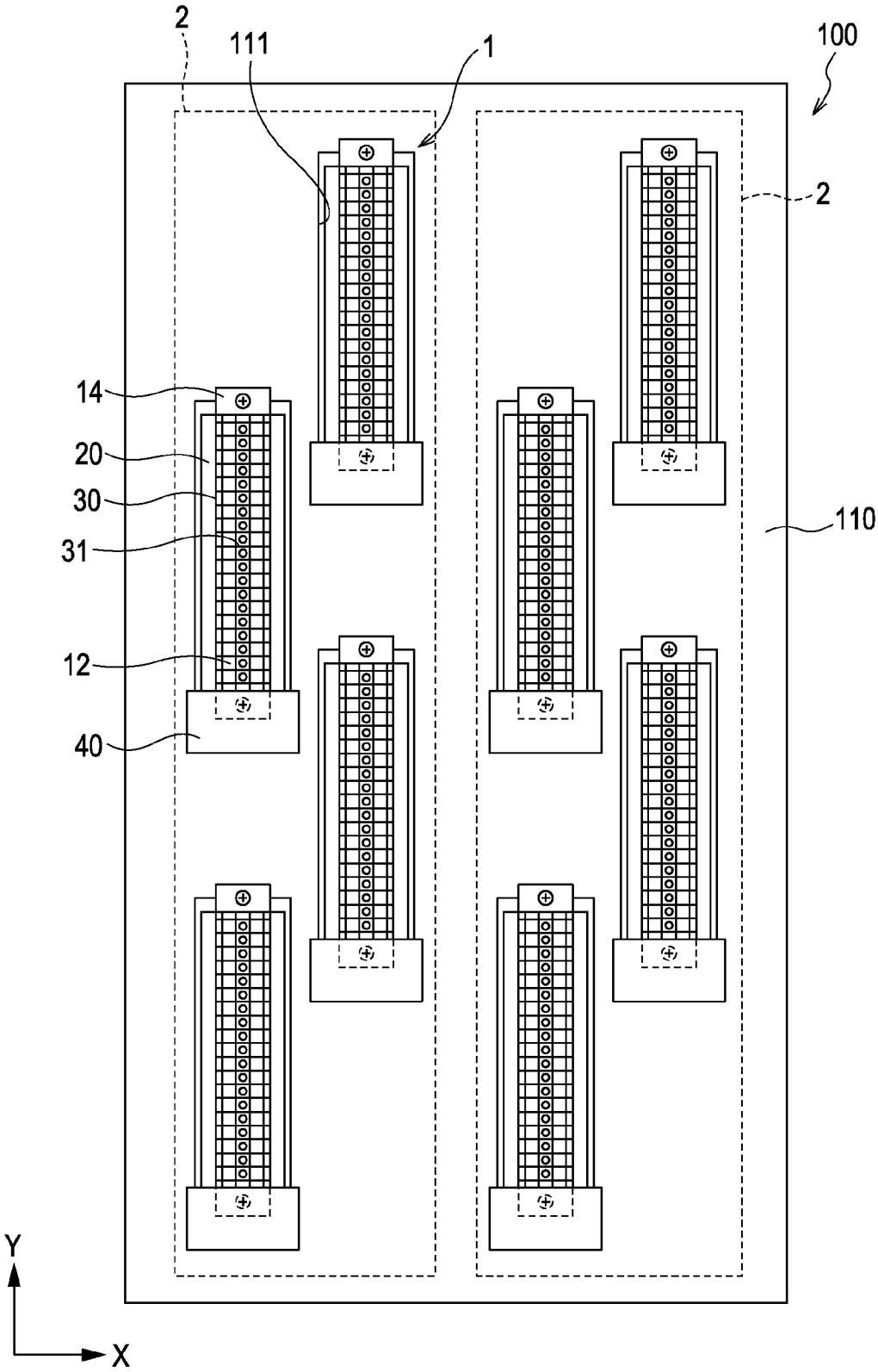
FIG. 4 is a bottom plan view of a head unit according to the first embodiment.

The recording head 1 consists of a head unit in which a plurality of recording heads is integrally fixed. Description will be made hereinafter regarding the head unit of the embodiment with reference to FIG. 4.

The head unit 100 has the plurality of recording heads 1 and a base plate 110 on which the plurality of recording heads 1 are fixed.

The base plate 110 is made from a plate shaped member such as stainless steel or the like, and has retaining holes 111 into which the liquid ejecting surface 12 of each recording head 1 is inserted. The retaining hole 111 has an opening area slightly larger than the outer periphery of the liquid ejecting surface 12 of the recording head 1. An opposite side of the liquid ejecting surface 12 of the recording head 1 is inserted within the retaining hole 111 of the base plate 110 so that a flange portion 14 that is disposed on the outer periphery of the recording head 1 is fixed by screws or the like at one side of the base plate 110.

In the embodiment, the plurality of recording heads 1 are successively disposed toward a first direction Y that is the direction of the rows of the nozzle openings 11. Also, a column that consists of the plurality of recording heads 1 which is aligned in rows in the first direction Y is disposed in two columns successive in a direction intersecting (a second direction X) with the direction of the rows (the first direction Y) of the nozzle openings 11. Two columns of the recording head 1 that are successive in the second direction X are arranged in positions that are slightly misaligned to each other in the second direction X. In other words, the two columns of the recording head 1 configure a head group so that the recording heads 1 are arranged in a zigzag shape. Thus, in one head group, adjacent recording heads 1 are disposed such that the nozzle opening 11 of the end portion of the nozzle column of one side recording head 1 and the nozzle opening 11 of the end portion of the nozzle column of the other side recording head 1 are in the same position in the direction of the rows (the first direction Y) of the nozzle openings 11. Accordingly, printing can be performed by two columns of the recording heads 1 across all areas in the width direction that is the direction intersecting with the transport direction of the recording medium. In the embodiment, two head groups that consist of four ink jet type recording heads 1 are disposed in the head unit 100.

Figure 5:
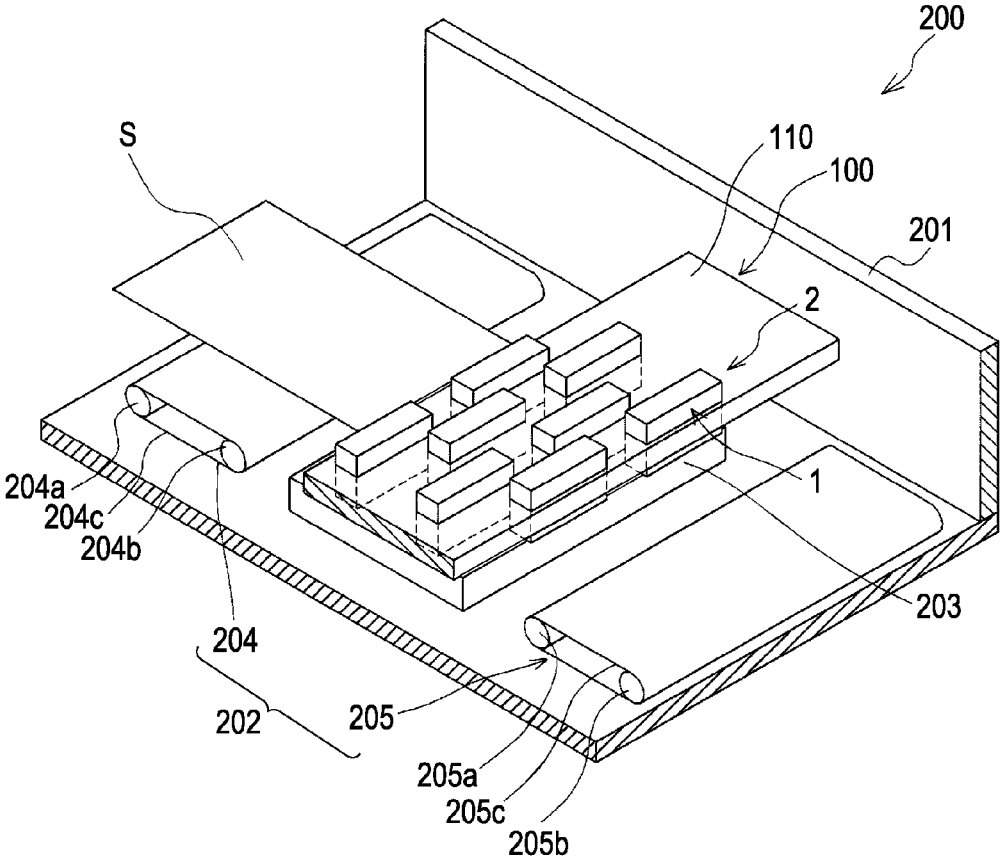
FIG. 5 is a perspective view schematically showing a recording apparatus according to the first embodiment.

The head unit 100 is loaded on an ink jet type recording apparatus 200. Hereinafter, description will be made regarding the ink jet type recording apparatus with reference to FIG. 5.

The ink jet type recording apparatus 200 that is an example of the liquid ejecting apparatus of the embodiment is a so called line-type recording apparatus, wherein the head unit 100 (the recording head 1) is fixed and a recording sheet S, such as paper or the like, that is the recording medium is transported so that the printing is performed. Specifically, the ink jet type recording apparatus 200 includes an apparatus main body 201, the head unit 100 that has a plurality of recording heads 1 and is fixed on the apparatus main body 201, a transport unit 202 that transports the recording sheet S and a platen 203 that supports the rear opposite to the printing surface of the recording sheet S that faces the head unit 100.

The head unit 100 is fixed on the apparatus main body 201 so that the direction of the rows (the first direction Y) of the nozzle opening 11 of the recording head 1 becomes the direction that intersects the transport direction of the recording sheet S.

The transport unit 202 includes a first transport unit 204 and a second transport unit 205 that are disposed on both sides of the transport direction of the recording sheet S with respect to the head unit 100.

The first transport unit 204 consists of a driving roller 204*a*, a driven roller 204*b* and a transport belt 204*c* that is wound on the driving roller 204*a* and the driven roller 204*b*. Also, the second transport unit 205 consists of a driving roller 205*a*, a driven roller 205*b* and a transport belt 205*c* similarly to the first transport unit 204.

A driving unit such as a driving motor (not shown) is connected to each of the driving rollers 204*a* and 205*a* of the first transport unit 204 and the second transport unit 205, and the transport belts 204*c* and 205*c* are rotated by the driving force of the driving unit so that the recording sheet S is transported to the upstream and the downstream of the head unit 100.

In the embodiment, the first transport unit 204 and the second transport unit 205 that consist of the driving rollers 204*a* and 205*a*, the driven rollers 204*b* and 205*b* and the transport belts 204*c* and 205*c* are illustrated, however a retaining unit that retains the recording sheet S on the transport belts 204*c* and 205*c* may be further disposed. As the retaining unit, for example, a charging unit that electrically charges the outer periphery of the recording sheet S may be disposed and the recording sheet S that is electrically charged by the charging unit may be absorbed on the transport belts 204*c* and 205*c* with a dielectric polarization effect. Also, as the retaining unit, pressing rollers may be disposed on the transport belts 204*c* and 205*c*, and the recording sheet S may be pinched between the pressing rollers and the transport belts 204*c* and 205*c*.

The platen 203 is made from metal, resin or the like that has a rectangular shape in cross section and is disposed between the first transport unit 204 and the second transport unit 205 to face the head unit 100. The platen 203 maintains the recording sheet S that is transported by the first transport unit 204 and the second transport unit 205 in a position that faces the head unit 100.

An absorption unit may be disposed on the platen 203 on which the transported recording sheet S is absorbed. As the absorption unit, for example, there are a suction and absorbing unit that suctions the recording sheet S, and a unit in which the recording sheet S is electro-statically absorbed by an electrostatic force, or the like.

An ink reservoir (not shown) such as an ink container, an ink cartridge or the like that stores ink is connected to each of recording heads 1 of the head unit 100 so as to supply ink. The ink reservoir for example, may be retained on the head unit 100 or may be retained on a position other than the head unit 100 within the apparatus main body 201.

In such the ink jet type recording apparatus 200, the recording sheet S is transported by the transport unit 204 and the recording sheet S that is supported on the platen 203 by the head unit 100 is printed. The transport unit 202 transports the printed recording sheet S.

In printing by the ink jet type recording apparatus 200, because the wall portions 20 that cover the liquid ejecting surface 12 at both sides of the transport direction of recording sheet S in the recording head 1 are disposed, the air stream may be prevented from being generated in the vicinity of the liquid ejecting surface 12 when the recording sheet S is transported. Specifically, because the recording head 1 of the embodiment is loaded on the ink jet type recording apparatus 200 so as to arrange the wall portions 20 in both sides of the transport direction, wind (air stream) that is generated when the recording sheet S is transported may be effectively suppressed by the wall portions 20. In other words, as the embodiment, in the case that the pair of wall portions 20 is disposed, the direction of the air stream that is generated by the air stream generating unit 40 may be defined according to the direction that the wall portions 20 are disposed.

Because the rectifying plate 30 is disposed so as to shield the transport area of the recording sheet S and the liquid ejecting surface 12, the air stream from the recording sheet S is shielded even by the rectifying plate 30 so that generation of the air stream in the vicinity of the liquid ejecting surface 12 may be suppressed.

Thus, the influence of the air stream due to the transport of the recording sheet S at the space 32 between the liquid ejecting surface 12 and rectifying plate 30 can be suppressed and the landing position of the small liquid droplet C can be controlled simply by the air stream from the air stream generating unit 40 so that the small liquid droplet C can be landed on the rectifying plate 30.

In the embodiment, the head unit 100 that has the plurality of recording heads 1 is loaded on the ink jet type recording apparatus 200; however, it is not specifically limited thereto, and one or more heads 1 may be directly loaded on the ink jet type recording apparatus 200. Also, a plurality of the head units 100 may be loaded on the ink jet type recording apparatus 200.

Second Embodiment

Figure 6:
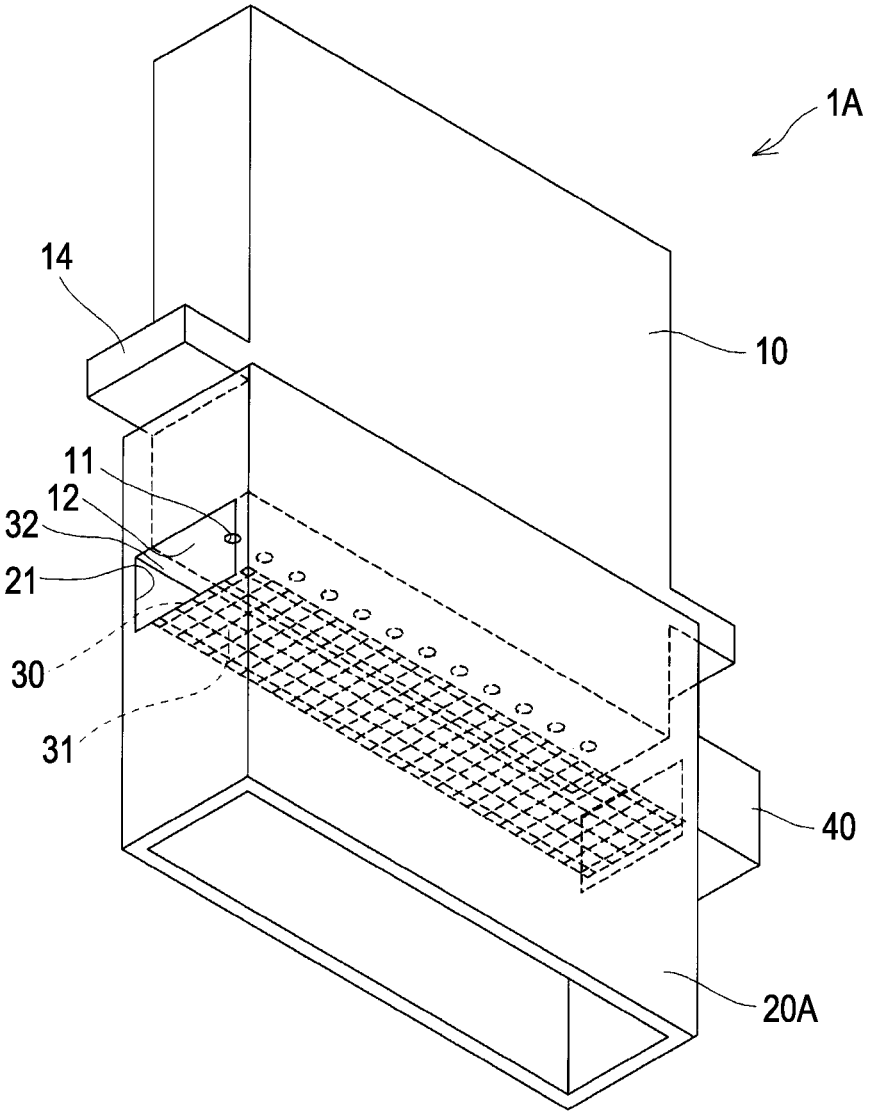
FIG. 6 is a perspective view of a recording head according to a second embodiment.
Figure 7A:
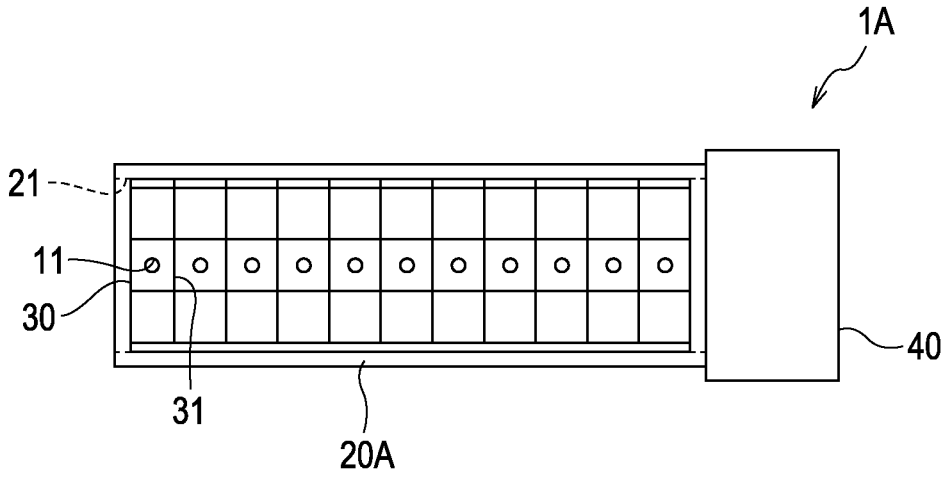
FIG. 7A is a bottom plan view of the recording head according to the second embodiment.
Figure 7B:
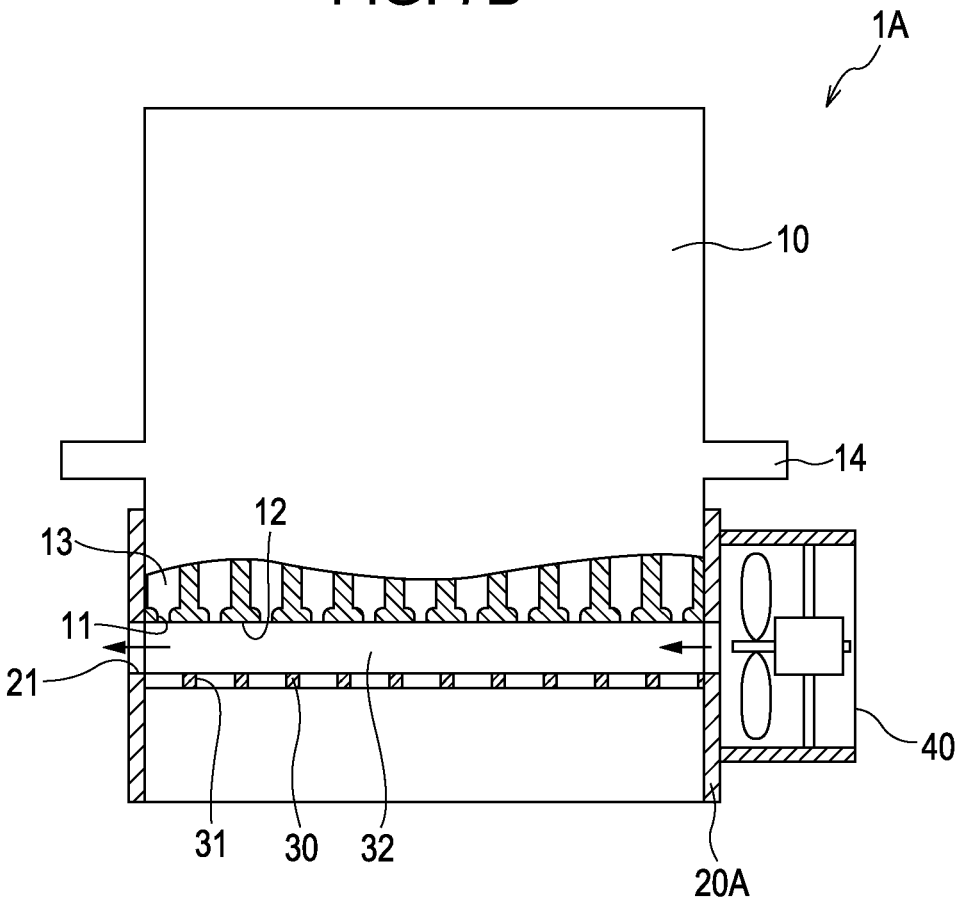
FIG. 7B is a cross-sectional view of main portions of the recording head according to the second embodiment.

FIG. 6 is a perspective view of an ink jet type recording head that is an example of a liquid ejecting head according to a second embodiment of the invention, FIG. 7A is a bottom plan view of the ink jet type recording head according to the second embodiment and FIG. 7B is a cross-sectional view of main portions of the ink jet type recording head according to the second embodiment. Also, constituent elements similar to those of the first embodiment described above are given similar reference numbers thereto, and are thus not described herein.

As shown in drawings, an ink jet type recording head 1A (also referred to as recording head 1A) has the head main body 10, a wall portion 20A, the rectifying plate 30 and the air stream generating unit 40.

In the embodiment, the wall portion 20A has a tube shape that is opened at the upper and lower ends, and is fixed through the periphery of the liquid ejecting surface 12 of the head main body 10. The rectifying plate 30 is fixed within the wall portion 20A and the wall portion 20A is extended to the recording medium (the recording sheet S) rather than the rectifying plate 30. Also, a communication hole 21 that communicates the space 32 between the liquid ejecting surface 12 and rectifying plate 30 with the outside is disposed in both surfaces of the wall portion 20A in the direction of the rows of the nozzle openings 11. The air stream generating unit 40 is fixed on one side of the communication hole 21 so that the air stream generating unit 40 generates the air stream through the communication hole 21 within the wall portion 20A. In other words, gas that is blown by the air stream generating unit 40 is supplied from one side of the communication hole 21, passed through the space 32, and then released to the outside from the other side of the communication hole 21. Accordingly, the gas that is blown by the air stream generating unit 40 contacts the wall portion 20A so that turbulent air stream is not easily generated.

As described above, because the wall portion 20A of the embodiment is made from the tube shape member in which the communication hole 21 is disposed, the wall portion 20A is successively disposed through the periphery of the side opposite the liquid ejecting surface 12 of the rectifying plate 30.

In the recording head 1A, because the area on which the ink flies of the recording medium of the rectifying plate 30 is covered by the wall portion 20A, the influence of external wind (air stream) on the main droplet B that is passed through the opening 31 of the rectifying plate 30 can be further suppressed and misalignment of the landing position can be further decreased.

In the embodiment, in the case that the wall portion 20A is disposed over the side surface of the recording sheet S (the side that opposes the liquid ejecting surface 12) of rectifying plate 30, because influence of the wind (air stream) in four directions can be suppressed, the recording head 1A may also be loaded on the ink jet type recording apparatus 200 so as to generate the air stream in the same direction as the transport direction of the recording sheet S.

Third Embodiment

Figure 8:
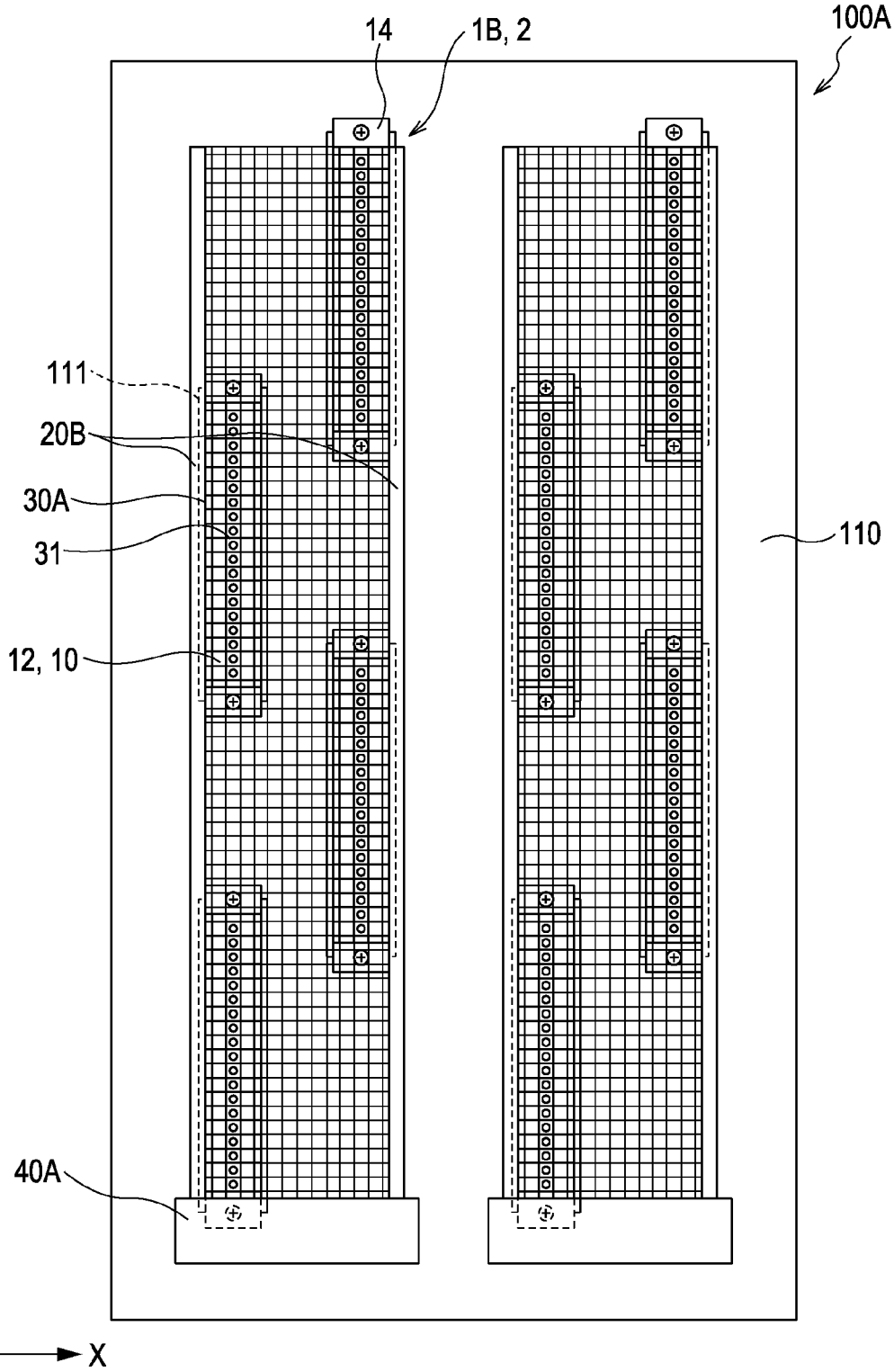
FIG. 8 is a bottom plan view of a head unit according to a third embodiment.

FIG. 8 is a bottom plan view of a head unit according to a third embodiment. Also, the constituent elements similar to those of the first embodiment, described above are given similar reference numbers thereto, and thus are not described herein.

As shown in FIG. 8, a head unit 100A of the embodiment has a plurality of recording heads 1B and a base plate 110.

The head main body 10 is fixed in each of retaining holes 111 of the base plate 110. In the embodiment, two head groups 2, which have the head main body 10 (two columns of the head main body 10) that is arranged in a zigzag shape the same as the first embodiment described above, are disposed. The head group 2 is formed by one recording head 1B in the embodiment.

Also, each of the head groups 2 that are formed by two columns of the head main body 10 that are successive in the second direction X is covered by common wall portions 20B.

The wall portion 20B is disposed on every recording head 1B and formed by a pair of plate shaped members that is continuously disposed along the direction of the rows (the same direction as the direction of the rows of the nozzle openings 11) of the plurality of head main bodies 10. In the embodiment, the wall portion 20B is disposed on both sides of the second direction X of the each recording head 1B (the head group 2).

One rectifying plate 30A that is common in each of the head main bodies 10 is disposed in each of the recording heads 1B (head group 2) of the head unit 100A.

The rectifying plate 30A is disposed to face the liquid ejecting surface 12 of the plurality of head main bodies 10. Also, the openings 31 of the rectifying plate 30A are disposed in the position that faces the nozzle openings 11 of all head main bodies 10 as the same as the first embodiment.

An air stream generating unit 40A including the blower is disposed in each of the recording heads 1B (the head group 2) and an air stream is generated between the liquid ejecting surface 12 of the plurality of head main bodies 10 and the rectifying plate 30A.

In the above-described configuration, the wall portions 20 and 20A, the rectifying plate 30 and the air stream generating unit 40 do not need to be disposed in each of the head main bodies 10, as in the above-described first and second embodiments, so that the number of parts is decreased and the costs can be reduced.

In the embodiment, the wall portions 20B, the rectifying plate 30A and air stream generating unit 40A are disposed in each of the recording head 1B (the head group 2); however, it is not specifically limited thereto; and a wall portion, a rectifying plate and an air stream generating unit that used in common may also be disposed in the plurality of head groups 2. In this case, the head unit 100A itself can be the recording head.

Of course, as the wall portion 20B of the embodiment, a part the same as the wall portion 20A of the second embodiment may also be used.

Other Elements

Each of the embodiments of the invention is described above; however, the basic configuration of the invention is not limited to the above description.

Figure 9A:
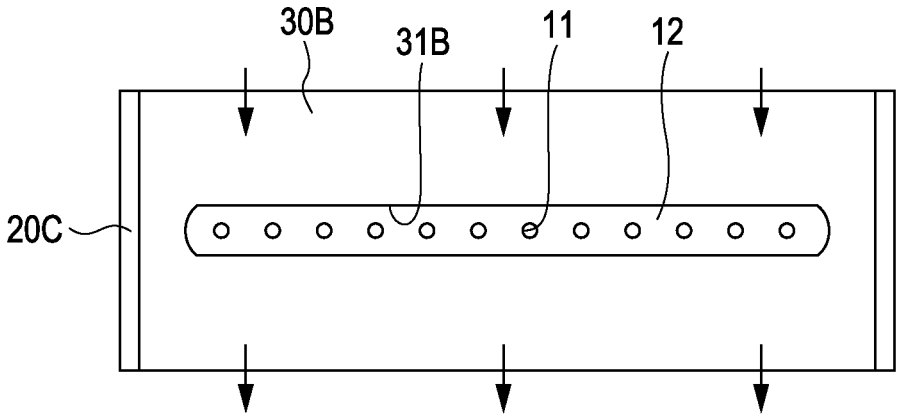
FIGS. 9A and 9B are plan views showing modified examples of a rectifying plate according to other embodiment.
Figure 9B:
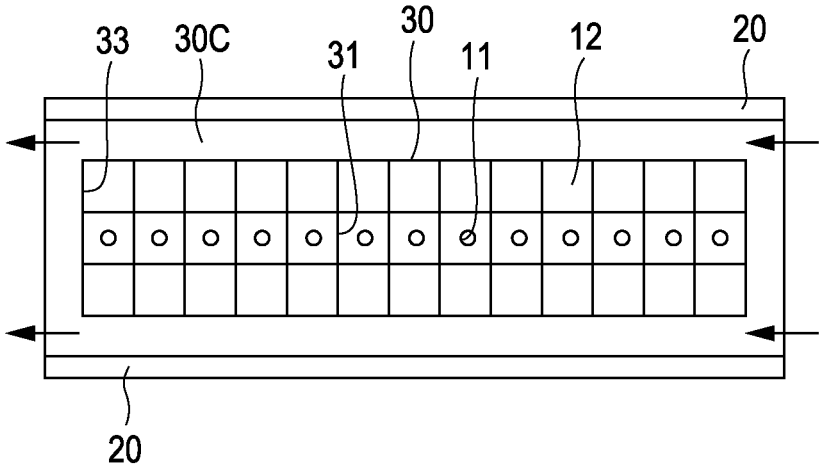

For example, in each of the above-described embodiments, a mesh shaped material is used in the rectifying plates 30 and 30A; however, it is not specifically limited to the above-described material or shape of the rectifying plates 30 and 30A. Other examples of the rectifying plate are shown in FIGS. 9A and 9B. FIGS. 9A and 9B are bottom plan views of the ink jet type recording head showing modified examples of a rectifying plate according to other embodiments.

As shown in FIG. 9A, a rectifying plate 30B is formed by a plate shaped member and one slit shaped opening 31B is disposed in the rectifying plate 30B that faces the plurality of nozzle openings 11. When an air stream is generated in the rectifying plate 30B along the longitudinal direction of the slit shaped opening 31B, because the small liquid droplets C pass through the slit shaped opening 31B and are landed on the recording medium (the recording sheet S), the air stream may be generated along the lateral direction of the slit shaped opening 31B. Accordingly, the pair of wall portions 20C may be disposed on both sides of the parallel direction of the nozzle openings 11 at the rectifying plate 30B.

Also, as shown in FIG. 9B, a rectifying plate 30C has one slit hole 33 that faces the plurality of nozzle openings 11 and the rectifying plate 30 that has openings 31 is fixed within the slit hole 33. In other words, the rectifying plate 30C as shown in FIG. 9B broadens the opening area of the slit shaped opening 31B of the rectifying plate 30B as shown in FIG. 9A, and has a configuration in which the rectifying plate 30 of the first embodiment is fixed within the slit hole 33. In the rectifying plate 30C, the air stream may be generated along the direction of the rows of the nozzle openings 11, or may also be generated along the direction intersecting the direction of the rows of the nozzle openings 11, and thus the attachment direction thereof is not limited.

In each of the embodiments described above, the air stream generating units 40 and 40A are disposed in the recording heads 1 and 1A, but are not specifically limited thereto. For example, one air stream generating unit may be disposed in each of the head units 100 and 100A, and the air stream generating unit may also be disposed in the ink jet type recording apparatus 200.

As the above-described air stream generating units 40 and 40A in each of the embodiments, for example, an air stream of gas having moisture may also be generated. A humidifier may be disposed to generate an air stream of gas having the moisture. As described above, the air stream generating unit generates the air stream that has moisture so that drying of the liquid in the vicinity of the nozzle openings is prevented from being promoted and ejection failures due to the drying and hardening of the liquid can be decreased by the air stream generated by the air stream generating unit.

In the first and second embodiments, as the ink jet type recording apparatus 200, the so-called line-type ink jet recording apparatus 200 is illustrated in which the recording head 1 (the head unit 100) is fixed and the printing is performed only by transport of the recording sheet S; however, it is not specifically limited thereto, and for example, a serial-type ink jet type recording apparatus in which the recording head 1 (the head unit 100) is moved in a main scanning direction with respect to the recording medium and the printing is performed may also be applied to the invention.

In the above-described embodiments, the ink jet type recording head has been described as an example of a liquid ejecting head and the ink jet type recording apparatus has been described as an example of a liquid ejecting apparatus, but the invention is widely intended for liquid ejecting heads and liquid ejecting apparatuses in general. The invention may be of course, applied to a liquid ejecting head or a liquid ejecting apparatus ejecting a liquid other than ink. Other examples of the liquid ejecting heads include, for example, various recording heads used for an image recording apparatus, such as a printer or the like, a color material ejecting head used to manufacture a color filter of a liquid crystal display or the like, an electrode material ejecting head used to form an electrode of an organic EL display, an FED (Field Emission Display), or the like, a bioorganic ejecting head that is used to manufacture a bio-chip, and the like. The invention may be also applied to a liquid ejecting apparatus that includes such a liquid ejecting head.

What is claimed is:

1. A liquid ejecting head comprising:

a head main body that has a nozzle opening for ejecting liquid, a rectifying plate that is disposed in a position away from a liquid ejecting surface on which the nozzle opening is opened and has an opening disposed in an area facing the nozzle opening, and an air stream generating unit that generates an air stream between the liquid ejecting surface and the rectifying plate along a surface direction of the liquid ejecting surface, wherein the air stream blows along a direction of rows of nozzle openings in the same direction for the rows of nozzle openings.

2. The liquid ejecting head according to claim 1, further including a wall portion that covers at least both surfaces in a direction intersecting with the air stream direction in a periphery of a space between the liquid ejecting surface and the rectifying plate.

3. The liquid ejecting head according to claim 2, wherein the wall portion is disposed over a periphery opposed to the liquid ejecting surface of the rectifying plate.

4. The liquid ejecting head according to claim 2, including the plurality of head main bodies, wherein the wall portion is continuously disposed over a periphery of the plurality of head main bodies.

5. The liquid ejecting head according to claim 1, wherein the rectifying plate is made of mesh shaped material.

6. The liquid ejecting head according to claim 1, wherein the air stream generating unit generates an air stream of gas having moisture.

7. A liquid ejecting head unit comprising two or more liquid ejecting heads, each liquid ejecting head including:

a head main body that has a nozzle opening for ejecting liquid, a rectifying plate that is disposed in a position away from a liquid ejecting surface on which the nozzle opening is opened and has an opening disposed in an area facing the nozzle opening, and an air stream generating unit that generates an air stream between the liquid ejecting surface and the rectifying plate along a surface direction of the liquid ejecting surface, wherein the air stream blows along a direction of rows of nozzle openings in the same direction for the rows of nozzle openings.

8. A liquid ejecting apparatus comprising the liquid ejecting head unit according to claim 7.

9. The liquid ejecting head unit of claim 7, wherein each liquid ejecting head further includes a wall portion that covers at least both surfaces in a direction intersecting with the air stream direction in a periphery of a space between the liquid ejecting surface and the rectifying plate.

10. A liquid ejecting apparatus comprising a liquid ejecting head, the liquid ejecting head including:

a head main body that has a nozzle opening for ejecting liquid, a rectifying plate that is disposed in a position away from a liquid ejecting surface on which the nozzle opening is opened and has an opening disposed in an area facing the nozzle opening, and an air stream generating unit that generates an air stream between the liquid ejecting surface and the rectifying plate along a surface direction of the liquid ejecting surface, wherein the air stream blows along a direction of rows of nozzle openings in the same direction for the rows of nozzle openings.

11. The liquid ejecting apparatus according to claim 10, wherein the liquid ejecting head further includes a wall portion that covers at least both surfaces in a direction intersecting with the air stream direction in a periphery of a space between the liquid ejecting surface and the rectifying plate.

* * * * *